US005689930A

United States Patent [19]

Anderson

[11] Patent Number: 5,689,930

[45] Date of Patent: Nov. 25, 1997

[54] HEAT REFLECTIVE AND/OR ABSORBENT MATERIAL

[76] Inventor: David John Anderson, 8 Westmere Drive, Mill Hill, London, United Kingdom, NW7 3HE

[21] Appl. No.: 530,228

[22] PCT Filed: Mar. 22, 1994

[86] PCT No.: PCT/GB94/00589

§ 371 Date: Sep. 21, 1995

§ 102(e) Date: Sep. 21, 1995

[87] PCT Pub. No.: WO94/21869

PCT Pub. Date: Sep. 29, 1994

[30] Foreign Application Priority Data

| | | | |
|---|---|---|---|
| Mar. 22, 1993 | [GB] | United Kingdom | 9305903 |
| Aug. 12, 1993 | [GB] | United Kingdom | 9316736 |

[51] Int. Cl.[6] ..... E04C 2/54

[52] U.S. Cl. ..... 52/786.11; 52/171.3; 52/306; 52/742.12; 428/34

[58] Field of Search ..... 52/171.3, 306, 52/786.11, 742.1, 742.12; 428/34, 38

[56] References Cited

U.S. PATENT DOCUMENTS

| | | | |
|---|---|---|---|
| 2,211,177 | 8/1940 | Snipischki | 52/306 |
| 2,931,270 | 4/1960 | Pennell | 52/306 X |
| 3,985,116 | 10/1976 | Kapany | 52/306 X |
| 3,999,345 | 12/1976 | McKelvey | 52/786.11 X |
| 4,035,539 | 7/1977 | Luboshez | 52/786.11 X |
| 4,109,431 | 8/1978 | Mazzoni et al. | 428/34 X |
| 4,443,987 | 4/1984 | Erb | 428/34 X |
| 4,563,843 | 1/1986 | Grether et al. . | |
| 4,813,198 | 3/1989 | Johnston et al. | 52/786.11 X |
| 4,986,048 | 1/1991 | McMarlin | 52/306 |
| 5,443,871 | 8/1995 | Lafond | 428/34 |
| 5,491,953 | 2/1996 | Lafond | 52/786.11 X |
| 5,505,788 | 4/1996 | Dinwoodie | 52/173.3 X |

FOREIGN PATENT DOCUMENTS

| | | |
|---|---|---|
| 0076875 | 4/1983 | European Pat. Off. . |
| 950800 | 2/1964 | United Kingdom . |
| 1542454 | 3/1979 | United Kingdom . |
| 2011985 | 7/1979 | United Kingdom . |
| 1593012 | 7/1981 | United Kingdom . |
| 2144476 | 3/1985 | United Kingdom . |
| 2202571 | 9/1988 | United Kingdom . |
| 2247040 | 2/1992 | United Kingdom . |

*Primary Examiner*—Carl D. Friedman
*Assistant Examiner*—Aimee E. McTigue
*Attorney, Agent, or Firm*—Caesar, Rivise, Bernstein, Cohen & Pokotilow, Ltd.

[57] ABSTRACT

A method of modifying a glazing panel having a box section, wherein the box section has walls of relatively transmissive material and such walls include a first pair of opposed walls, the method comprising the first step of forming a longitudinally-extending sheet of material selected from the group consisting of a heat reflective material, a heat absorbent material and a heat absorbent and reflective material to have a major web portion and a longitudinal fold defining a side portion having a free edge remote from the fold, the second step involving folding the side portion to extend substantially at right angles to the web portion and inserting the so-folded length in the box section so that the major web portion extends between the pair of opposed inner walls of the box, and the free edge of the side portion remote from the fold contacts with another inner wall of the box.

9 Claims, 1 Drawing Sheet

HEAT REFLECTIVE AND/OR ABSORBENT MATERIAL

The invention relates to heat reflective and/or absorbent material particularly for use in glazing panels and in particular in panels including a portion of substantially box section. Such a panel is typically used as a wall, usually a roof, of a conservatory or similar structure. The panel is typically made of a plastic having relatively low heat transmissive material, an example being polycarbonate or the like.

In my prior patent application 90.17787.4 published under no. 224704OA I have described and claimed an invention in which an extra layer is placed in a box section of the glazing pane. The extra layer comprises relatively reflective and/or absorbent material and takes the form of a film, mesh or perforated sheet optionally coated with e.g. metal. One needs to be skilful to apply the layer in the proper place. I have now discovered a better way of placing the required layer within the box section of a glazing panel.

My invention is based on the realisation that a length of suitable material can be folded to form at least one side portion and the general shape of tape. In use, the side portion can be moved to form a relatively rigid structure so that the tape can then readily be pushed into the box section from one end. In this way the inconveniences of applying a layer of film, mesh or sheet of material are avoided.

In one aspect the invention provides a length of heat reflective and/or absorbent material, the length including a longitudinal fold adjacent one of the longer sides to define a side portion and a web portion, the side portion being foldable along the longitudinal fold line relative to the web portion and arranged so that when the side portion is moved to lie generally orthogonally to the web a relatively rigid structure is formed.

The side portions may be disposed in line with the web portion (as seen in end elevation) or may be folded over or under the web portion. In such a case there are preferably two opposite side portions so that when both side portions lie generally parallel an article of generally U-shape is formed. The length may be reeled up into tape form. It may be advantageous to fold one side portion over the web portion and the other side portion underneath so that the side portions can be longer than half the width of the web.

In another embodiment there are preferably two opposite side portions extending in opposite directions from the plane of the major web portion whereby an article of generally Z-shape may be formed. This has the extra advantage that in use the web divides the box section into two parallel compartments which makes it possible to control the heat flow selectively.

In another aspect, the invention provides a glazing panel including a portion of box section, the box having walls of relatively transmissive material, an element in the form of a length of relatively reflective and/or absorbent material being present within the box, the element comprising a major web portion extending between a pair of opposed inner walls of the box, and having at least one side portion foldable along a longitudinal fold adjacent one of the longer sides, the side portion being arranged to lie generally orthogonally to the web to form a relatively rigid structure and the free end of the side portion being in contact with another inner wall of the box.

In one embodiment the major web portion of the element or tape is in contact with one inner wall of the box while extending between second and third inner walls and the free end of the side portion is in contact with the fourth inner wall. In this embodiment, most preferably the element has two opposite side portions which extend in generally parallel relation so that the element is of generally U-shape.

In a second embodiment, the major web portion of the tape extends between a first pair of opposed inner walls but is spaced from the second pair of opposed inner walls of the box. In this embodiment the major web portion is maintained in its spaced relationship to the second pair of inner walls by the at least one side portion whose free end is in contact with one of the second pair of inner walls.

Preferably in this second embodiment, the tape has two opposite side portions extending in generally opposite directions from the major web portion so that in the box the element is of generally Z-shape.

The effective width of the web (between opposite sides of the box in use) may be increased by folds, corrugations or the like.

In a more specific aspect the invention provides a glazing panel including a portion of box section, an element of relatively reflective and/or absorbent material being present within the box, the element comprising a major web portion extending between a pair of opposed inner walls of the box, and having two opposite side portions integrally formed with the web portion, the foot of at least one of the side portions being in contact with the another inner wall, the material defining the joins of the web and the side portions having been folded.

Thus in one specific aspect the invention provides a method of improving the heat reflective and/or absorbing properties of a glazing panel having a portion of box section, the method comprising inserting a length of a material having reflective and/or absorbing properties into the box section from one end thereof, the element comprising a major web portion to extend between a pair of opposed inner walls of the box and a side portion dimensioned to contact another inner wall of the box, the side portion being disposed substantially at a right angle to the web whereby the element is rigid.

The material of relatively reflective and/or absorbent material of which the element is formed may be a substrate, e.g. plastics having a metallic layer or a plastics or paper coated metal. The metallic layer may be polished aluminium, stainless steel, or titanium. The metallic layer may be plated with chromium, gold, silver, zinc or cadmium, or the like. The metallic layer may be polished and coated with a transparent coating. The material may be made as a laminate construction; it may be of polyester with a metal or metal oxide coating which has been stabiiised to resist deterioration due to moisture. The material may be perforated. In this instance it may be advantageous to seal the box sections, e.g. with adhesive/impervious tape against the ingress of moisture. In another alternative, a polyester insert with a metal/metal oxide coating may advantageously be used in a full sealed and desiccated box section roof, in which case the stabilisation usually necessary to resist moisture may not then be necessary.

In order that the invention may be well understood it will now be described with reference to the accompanying diagrammatic drawings in which.

Figure 1:
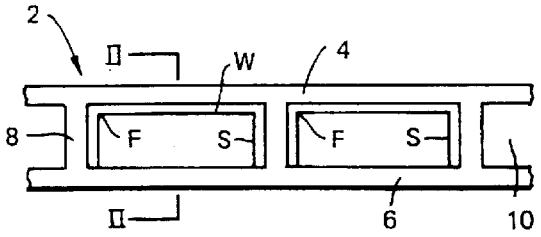
FIG. 1 is an end view of two box sections of a glazing panel each incorporating an element of the invention according to a first embodiment.

A plastic roof glazing sheet 2, has two layers 4, 6 of relatively transmissive (normally clear) material. Commonly the relatively transmissive material is polycarbonate. The layers 4, 6 are spaced apart by integral webs 8 of the same material. Although shown schematically plane, the outer surfaces of the layers 4 and 6 are normally somewhat ribbed. The construction produces a series of side by side box sections 10. As discussed and claimed in my earlier patent application 90.17787.4 (publication 2247040) it is advantageous to include a layer of relatively reflective and/or absorbent material between the layers 4, 6 which can produce a performance equal to that of high performance solar glass.

Figure 2:
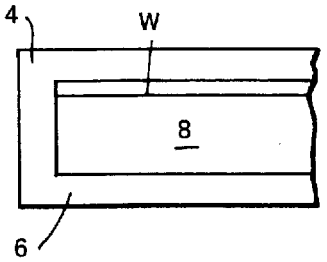
FIG. 2 is a longitudinal sectional view taken on lines II—II on FIG. 1.
Figure 3:
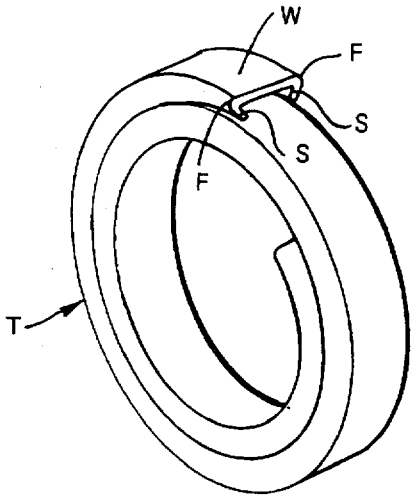
FIG. 3 is an end view of a portion of the tape in folded condition

In accordance with the embodiment shown in FIGS. 1 and 2, the element is provided by a tape T shown in FIG. 3. The tape T comprises a length of metallised plastics film which has been provided with two longitudinal folds F to divide the tape into a major web portion W and two equal opposite side portions S. The folds F are placed so that the side portions S equal the height of the partitions 8 and the web W equals the width of ceiling of each box section. After the folds F have been placed the side portions S underlie the web W so that the tape T may be reeled to the condition as shown in FIG. 3. In use a length of the tape T is unreeled and the side portions bent to lie generally parallel to each other and at right angles to the web W, so that the overall cross sectional shape is that of a U or staple. The element is then rigid and may be pushed from one end into the box section easily. The element is then firmly located in the box section. The elements may be inserted at the factory or on site, e.g. by a householder.

Figure 4:
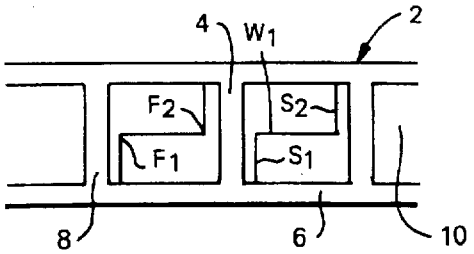
FIG. 4 is a similar view to FIG. 1 incorporating an element according to a second embodiment of the invention.

An alternative embodiment is shown in FIG. 4. Here the element comprises a length of similar metallised plastics film which has been provided with two longitudinal folds, F1, F2, to divide the tape into a major web portion W1 and two side portions S1 and S2 extending in opposite directions from web W1 to form a lazy Z-shape. The element in Z-shape is sufficiently rigid to be pushed easily into the box section from one end at the factory or on site. The web divides the box section into two longitudinal ducts.

Figure 5:
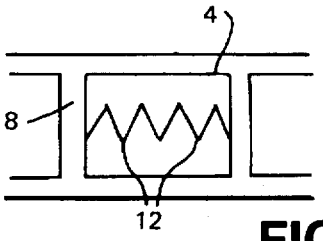
FIG. 5 is a view similar to FIG. 1 incorporating a third embodiment of element according to the invention.

The folds F1 and F1 are positioned so that $S_1$ and $S_2$ are together substantially equal in length to the height of partition 8. $S_1$ and $S_2$ may be of equal length but this is not essential. Neither is it essential that $S_1$ and $S_2$ be equal in length to the height of partition 8 although it is usually preferred, that the free end of $S_2$ contacts the upper inner wall of its box 10. In the embodiment of FIG. 5, the tape has generally parallel corrugations 12 and is tensioned between opposite side walls 8 of the box.

The invention is not limited to the embodiments shown. The tape may be of sufficient width to form four sides to define a duct. The elements need not be in adjacent box sections. The panel may have more than one row of box sections which may or may not be of the same dimensions. The tape may be flat. The tape may adhere from the ceiling of the box either using an adhesive or by a surface contact.

The box sections containing the elements define ducts in which air is heated by absorption or reflection of solar energy from the inserted elements. This heat is then passed to heat other parts of a building, generate electricity or the like and in this way the invention converts the roof into a solar collection panel.

I claim:

1. A method of improving the properties of a glazing panel, said glazing panel comprising generally parallel passageways of box sections and having a plurality of inner walls of relatively transmissive material, the method comprising the first step of forming a longitudinally extending generally foldable sheet of material selected from the group consisting of a heat reflective material, a heat absorbent material and a heat absorbent and reflective material to have a major web portion and a longitudinal fold defining a side portion having a free edge remote from the fold, followed by the second step of folding the side portion to extend substantially at right angles to the web portion whereby to make relatively rigid the so folded longitudinal sheet to achieve a folded relatively rigid sheet, followed by the third step of inserting from one end of a passageway to be treated, an elongate portion of said folded relatively rigid sheet to cause the major web portion thereof to extend between opposed inner walls of the passageway and the free edge to contact another inner wall of the passageway.

2. A method according to claim 1 wherein said box sections have first, second, third and fourth inner walls and wherein the folded sheet is inserted so that the major web portion contacts one inner wall of the box while extending between second and third inner walls and the free edge of the side portion contacts with a fourth inner wall.

3. A glazing panel with comprises a plurality of generally parallel passageways to provide box sections, each box section having walls of relatively transmissive material, at least some of the passageways containing a rigid length of sheet material selected from the group consisting of relatively heat reflective material, relatively heat absorbent material and relatively heat absorbent and reflective material, the length of sheet material comprising a major web portion and side portions extending between opposed inner walls of the box section passageway, and at least one side portion separated from the major web portion by a longitudinal fold line and having a free edge remote from the fold line, the side portion being in contact with another inner wall of the box section.

4. A panel according to claim 3, wherein the box sections have first, second, third and fourth inner walls and wherein the major web portion of the length of sheet material is in contact with one inner wall of the passageway while extending between second and third inner walls and the free edge of the side portion is in contact with a fourth inner wall.

5. A panel according to claim 4, wherein the length of sheet material has two opposite side portions which extend in generally parallel relation so that the length of sheet material is of generally U-shape.

6. A panel according to claim 3, wherein the major web portion of the length of sheet material extends between a first pair of opposed inner walls and is spaced from a second pair of opposed inner walls of passageway.

7. A panel according to claim 6, wherein the major web portion is maintained in its spaced relationship to the second pair of inner walls by at least one side portion whose free edge is in contact with one of the second pair of inner walls.

8. A panel according to claim 6, wherein the length of sheet material has two opposite side portions extending in generally opposite directions from the major web portion so that in the passageway the length of sheet material is of generally Z-shape.

9. A panel according to claim 3 wherein the web includes folds or corrugations to increase the effective length thereof.

* * * * *